US011078723B2

(12) United States Patent
Anderson

(10) Patent No.: US 11,078,723 B2
(45) Date of Patent: Aug. 3, 2021

(54) SKEW ADJUSTMENT MECHANISM FOR A WINDOW COVERING

(71) Applicant: Hunter Douglas Inc., Pearl River, NY (US)

(72) Inventor: Richard N. Anderson, Whitesville, KY (US)

(73) Assignee: HUNTER DOUGLAS INC., Pearl River, NY (US)

( * ) Notice: Subject to any disclaimer, the term of this patent is extended or adjusted under 35 U.S.C. 154(b) by 340 days.

(21) Appl. No.: 16/165,814

(22) Filed: Oct. 19, 2018

(65) Prior Publication Data

US 2019/0055780 A1 Feb. 21, 2019

Related U.S. Application Data

(63) Continuation of application No. 15/227,056, filed on Aug. 3, 2016, now Pat. No. 10,119,329.

(60) Provisional application No. 62/306,594, filed on Mar. 10, 2016, provisional application No. 62/285,017, filed on Mar. 4, 2016, provisional application No. 62/203,998, filed on Aug. 12, 2015.

(51) Int. Cl.

| | |
|---|---|
| ***E06B 9/322*** | (2006.01) |
| ***E06B 9/382*** | (2006.01) |
| ***E06B 9/388*** | (2006.01) |
| ***E06B 9/304*** | (2006.01) |

(52) U.S. Cl.

CPC ..... *E06B 9/322* (2013.01); *E06B 9/304* (2013.01); *E06B 9/382* (2013.01); *E06B 9/388* (2013.01)

(58) Field of Classification Search

CPC ..... E06B 9/322; E06B 9/324; E06B 9/326; E06B 9/304; E06B 9/382; E06B 9/388; E06B 2009/3225; E06B 2009/3222

See application file for complete search history.

(56) References Cited

U.S. PATENT DOCUMENTS

| | | | |
|---|---|---|---|
| 2,560,858 | A | 7/1951 | Grogan |
| 3,327,765 | A | 6/1967 | Strahm et al. |
| 5,228,491 | A | 7/1993 | Rude et al. |
| 5,482,100 | A | 1/1996 | Kuhar |

(Continued)

FOREIGN PATENT DOCUMENTS

| | | |
|---|---|---|
| DE | 102009008773 | 8/2010 |
| EP | 1020612 | 7/2000 |

(Continued)

OTHER PUBLICATIONS

Colombian Office Action issued in corresponding Application No. NC2016/0000850 dated Aug. 20, 2019 (8 pages).

(Continued)

*Primary Examiner* — Johnnie A. Shablack

(74) *Attorney, Agent, or Firm* — Dority & Manning, P.A.

(57) ABSTRACT

A skew adjustment mechanism is used for adjusting the length of a lift cord on a window covering. The lift cord extends from a lift spool at a first end to an anchor drum at a second end. A cord wrap post is provided between the lift spool and the anchor drum so that the lift cord can be wrapped around the cord wrap post to provide friction between the lift cord and the cord wrap post when the lift cord is taut in order to reduce the amount of holding force that is needed to prevent the anchor drum from rotating.

21 Claims, 8 Drawing Sheets

(56) References Cited

U.S. PATENT DOCUMENTS

| | | | | |
|---|---|---|---|---|
| 6,119,757 | A | 9/2000 | Judkins et al. | |
| 6,530,415 | B2 | 3/2003 | Wu | |
| 6,736,186 | B2 * | 5/2004 | Anderson | E06B 9/32 160/168.1 P |
| 6,792,997 | B2 | 9/2004 | Damiano | |
| 6,948,216 | B2 | 9/2005 | Gaudyn et al. | |
| 7,178,576 | B2 | 2/2007 | Nien et al. | |
| 7,296,606 | B2 | 11/2007 | Liang | |
| 7,597,131 | B2 | 10/2009 | Nien et al. | |
| 7,886,803 | B2 | 2/2011 | Anderson et al. | |
| 8,087,445 | B2 * | 1/2012 | DeWard | E06B 9/322 160/170 |
| 8,186,413 | B2 | 5/2012 | Fujita et al. | |
| 8,857,494 | B2 | 10/2014 | Kirby et al. | |
| 8,887,786 | B2 | 11/2014 | Anderson et al. | |
| 8,944,135 | B2 | 2/2015 | Spray | |
| 8,997,827 | B2 | 4/2015 | Anderson et al. | |
| D733,460 | S | 7/2015 | Corey et al. | |
| 9,181,751 | B1 | 11/2015 | Hong | |
| 9,212,519 | B2 | 12/2015 | Vrooman | |
| 9,284,772 | B2 | 3/2016 | Yu et al. | |
| 9,284,774 | B2 * | 3/2016 | Yu | E06B 9/30 |
| 9,297,203 | B2 * | 3/2016 | Hsueh-Cheng | E06B 9/322 |
| 9,357,868 | B2 | 6/2016 | Anderson et al. | |
| 9,435,154 | B2 * | 9/2016 | Chen | E06B 9/262 |
| 9,458,664 | B2 | 10/2016 | Wen et al. | |
| 9,482,048 | B2 | 11/2016 | Anderson et al. | |
| 9,708,851 | B2 | 7/2017 | Huang | |
| 9,752,380 | B2 | 9/2017 | Anderson et al. | |
| 10,119,329 | B2 * | 11/2018 | Anderson | E06B 9/304 |
| 10,273,748 | B2 * | 4/2019 | Chen | E06B 9/322 |
| 10,480,244 | B2 * | 11/2019 | Chen | E06B 9/78 |
| 10,550,635 | B2 * | 2/2020 | Lin | E06B 9/305 |
| 10,704,323 | B2 * | 7/2020 | Chen | E06B 9/322 |
| 10,774,582 | B2 * | 9/2020 | Chen | F16H 19/0672 |
| 2004/0188038 | A1 | 9/2004 | Nien | |
| 2006/0249263 | A1 | 11/2006 | Liang | |
| 2007/0029056 | A1 | 2/2007 | Huang et al. | |
| 2007/0107854 | A1 * | 5/2007 | Jelic | E06B 9/30 160/170 |
| 2007/0272364 | A1 | 11/2007 | Liang | |
| 2008/0087387 | A1 | 4/2008 | Chen | |
| 2008/0099159 | A1 | 5/2008 | Nien | |
| 2009/0294076 | A1 | 12/2009 | McNiel | |
| 2010/0206492 | A1 | 8/2010 | Sherrick | |
| 2012/0060329 | A1 | 3/2012 | Zhang | |
| 2012/0227912 | A1 | 9/2012 | Anderson et al. | |
| 2012/0312486 | A1 | 12/2012 | Spray | |
| 2013/0032300 | A1 * | 2/2013 | Yu | E06B 9/322 160/84.02 |
| 2013/0313497 | A1 | 11/2013 | Hsu et al. | |
| 2014/0246156 | A1 | 9/2014 | Dorney et al. | |
| 2014/0374034 | A1 | 12/2014 | Corey et al. | |
| 2015/0013920 | A1 | 1/2015 | Mullet et al. | |
| 2015/0020980 | A1 | 1/2015 | Franssen | |
| 2015/0129142 | A1 | 5/2015 | Huang | |
| 2015/0275573 | A1 | 10/2015 | Huang | |
| 2016/0032645 | A1 | 2/2016 | Wen et al. | |
| 2016/0251896 | A1 | 9/2016 | Anderson et al. | |
| 2016/0298385 | A1 | 10/2016 | Chen | |
| 2016/0340976 | A1 | 11/2016 | Wen et al. | |
| 2017/0044822 | A1 | 2/2017 | Anderson et al. | |
| 2017/0107075 | A1 * | 4/2017 | Hung | E06B 9/32 |
| 2019/0055780 | A1 * | 2/2019 | Anderson | E06B 9/322 |

FOREIGN PATENT DOCUMENTS

| | | |
|---|---|---|
| EP | 2787161 | 10/2014 |
| WO | WO 9954584 | 10/1999 |

OTHER PUBLICATIONS

International Search Report issued in corresponding Application No. TW105125611, dated Jan. 15, 2020, (1 page).

* cited by examiner

SKEW ADJUSTMENT MECHANISM FOR A WINDOW COVERING

CROSS-REFERENCE TO RELATED APPLICATIONS

The present application is a continuation of U.S. patent application Ser. No. 15/227,056 filed on Aug. 3, 2016, which, in turn, is based upon and claims priority to U.S. Provisional Patent Application Ser. No. 62/203,998 filed on Aug. 12, 2015, U.S. Provisional Patent Application No. 62/285,017 filed on Mar. 4, 2016, and U.S. Provisional Patent Application No. 62/306,594 filed on Mar. 10, 2016, the disclosures of all of which are hereby incorporated by reference herein in their entirety for all purposes.

FIELD OF THE INVENTION

The present subject matter relates, generally, to a skew adjustment mechanism for a window covering. More specifically, the present subject matter relates to a skew adjustment mechanism that may be used to adjust the length of a lift cord for a shade or blind.

BACKGROUND

In typical prior art arrangements, in order to adjust a movable rail of a window covering such as a shade or blind that is skewed (not horizontal or not parallel to the head rail) after installation, the operator must disengage at least one of the lift cords from the skewed rail (such as a movable bottom rail or a movable intermediate rail), adjust the length of the lift cord, and reattach the lift cord to the rail. This is generally not something the end user is capable of doing, and it may even present a challenge to a seasoned installer.

U.S. Pat. No. 8,944,135 to Spray ("the Spray '135 patent"), which is hereby incorporated by reference herein in its entirety for all purposes, discloses a skew adjustment mechanism that adjusts the length of the lift cord at the end of the cord opposite the lift spool (the anchor end of the lift cord). The anchor end of the lift cord is secured to an anchor drum mounted for selective rotation within a housing. The lift spool rotates to extend and retract the lift cord as the movable rail moves up and down to extend and retract the window covering. The anchor spool is stationary as the movable rail moves up and down, but the anchor spool can be rotated manually to adjust the length of the lift cord to adjust for a skewed condition.

Column 2, lines 35-41, of the Spray '135 patent states, "The drum is retained in selected positions relative to the housing with two separate retaining systems so that once the drum is set relative to the housing for a pre-selected length of the lift cord, it will substantially retain this position until the position is adjusted by overcoming the retaining systems with a screwdriver or other similar tool." The two retaining systems include two sets of teeth—one set directed radially and one set directed axially. Projections on the housing engage the teeth to provide a holding force that prevents the anchor drum from rotating once its position has been established by the user.

While the use of two retaining systems helps retain the anchor drum in the desired position, even two retaining systems may not be sufficient to prevent the anchor drum from rotating when the window covering is heavy and exerts substantial force on the anchor drum through the lift cord.

Accordingly, an improved skew adjustment mechanism would be welcomed in the technology.

SUMMARY

In one aspect, the present subject matter is directed to a modified skew adjustment mechanism which reduces, if not eliminates, the possibility of a heavy window covering inadvertently causing rotation of the anchor drum of the skew adjustment mechanism and consequent unlocking of the skew adjustment mechanism and skewing of the rail with which the mechanism is associated. For example, in several embodiments, the present subject matter provides a cord wrap post about which the lift cord wraps as the lift cord extends from the lift spool to the anchor drum. In operation, the friction between the cord wrap post and the lift cord substantially reduces the load that the window covering exerts on the anchor drum through the lift cord, which, in turn, reduces the amount of holding force that has to be exerted by the anchor drum securement to hold the anchor drum in position once the anchor drum has been adjusted to the desired position by the user. Thus, the effect of the weight of a heavier shade on the anchor drum is minimized. Additionally, in one embodiment, the cord wrap post may define a retaining shoulder or stop to prevent the lift cord from slipping off the free end of the cord wrap post.

Moreover, in accordance with aspects of the present subject matter, the lift spool may be mounted on a fixed rail or on a movable rail, and a first end of the lift cord may be secured to the lift spool. The anchor drum may then be mounted on the rail on which the other end of the lift cord is anchored. If the window covering only includes a single fixed rail and a single movable rail, the lift spool may be mounted in either the fixed rail or the movable rail, and the anchor drum may be mounted in the other rail. If the window covering includes more than one movable rail, then more possibilities may exist for mounting locations. For example, the lift spool may be mounted on one movable rail and the anchor drum may be mounted on another movable rail. It also should be clear that, if an anchor drum is provided for each lift cord, the disclosed skew adjustment mechanisms may be used not just to straighten out (i.e., remove the skew from) a movable rail of a window covering but also to shorten (or lengthen) the overall length of the window covering.

The present subject matter is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular embodiments or arrangements illustrated herein.

BRIEF DESCRIPTION OF THE DRAWINGS

The accompanying drawings are provided for purposes of illustration only, and the dimensions, positions, order, and relative sizes reflected in the drawings attached hereto may vary. The detailed description will be better understood in conjunction with the accompanying drawings, wherein like reference characters represent like elements, as follows.

DESCRIPTION

Figure 1:
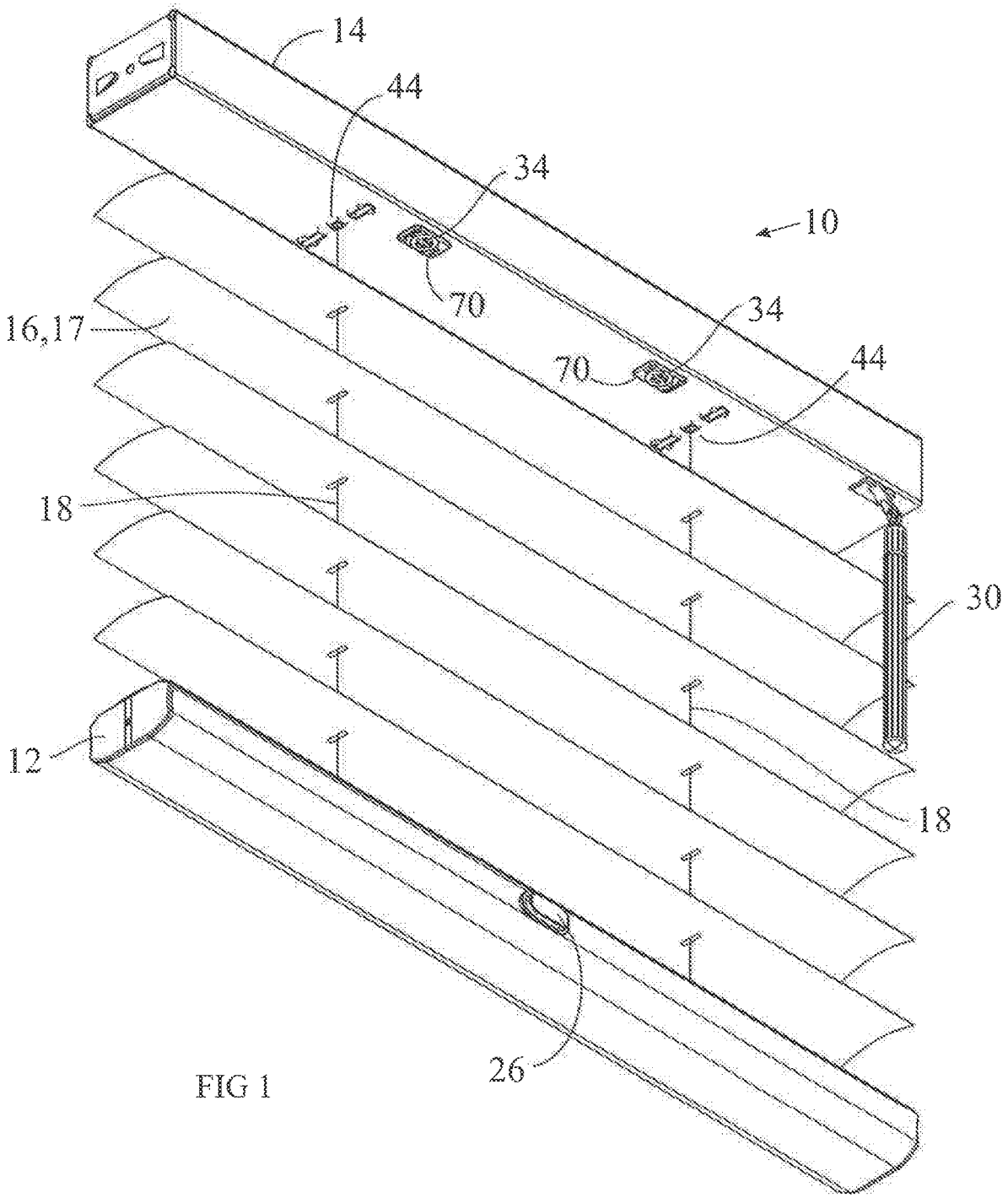
FIG. 1 illustrates a perspective view of one exemplary embodiment of a window covering (e.g., a blind) in accordance with aspects of the present subject matter, with the window covering including a skew adjustment mechanism provided in operative association with each lift cord.

Reference now will be made in detail to embodiments of the present subject matter, one or more examples of which are illustrated in the drawings. Each example is provided by way of explanation of the present subject matter, not limitation of the present subject matter. In fact, it will be apparent to those skilled in the art that various modifications and variations can be made in the present disclosure without departing from the scope or spirit of the present subject matter. For instance, features illustrated or described as part of one embodiment can be used with another embodiment to yield a still further embodiment. Thus, it is intended that the present subject matter covers such modifications and variations as come within the scope of the appended claims and their equivalents.

As indicated above, the present subject matter is generally directed to a skew adjustment mechanism for a window covering. In several embodiments, the skew adjustment mechanism may include an anchor drum housing and an anchor drum configured to be coupled to the anchor housing, with a lift cord of the window covering being configured to extend between the anchor drum and a separate lift spool. Additionally, in accordance with aspects of the present subject matter, a cord wrap post may be provided at a suitable location between the anchor drum and the lift spool to allow the lift cord to be wrapped around the cord wrap post as the lift cord extends between the anchor drum and the lift spool. As such, when the lift cord is taut, the friction provided between the cord wrap post and the lift cord may reduce the amount of holding force that is needed to prevent the anchor drum from rotating relative to the anchor drum housing.

Figure 2:
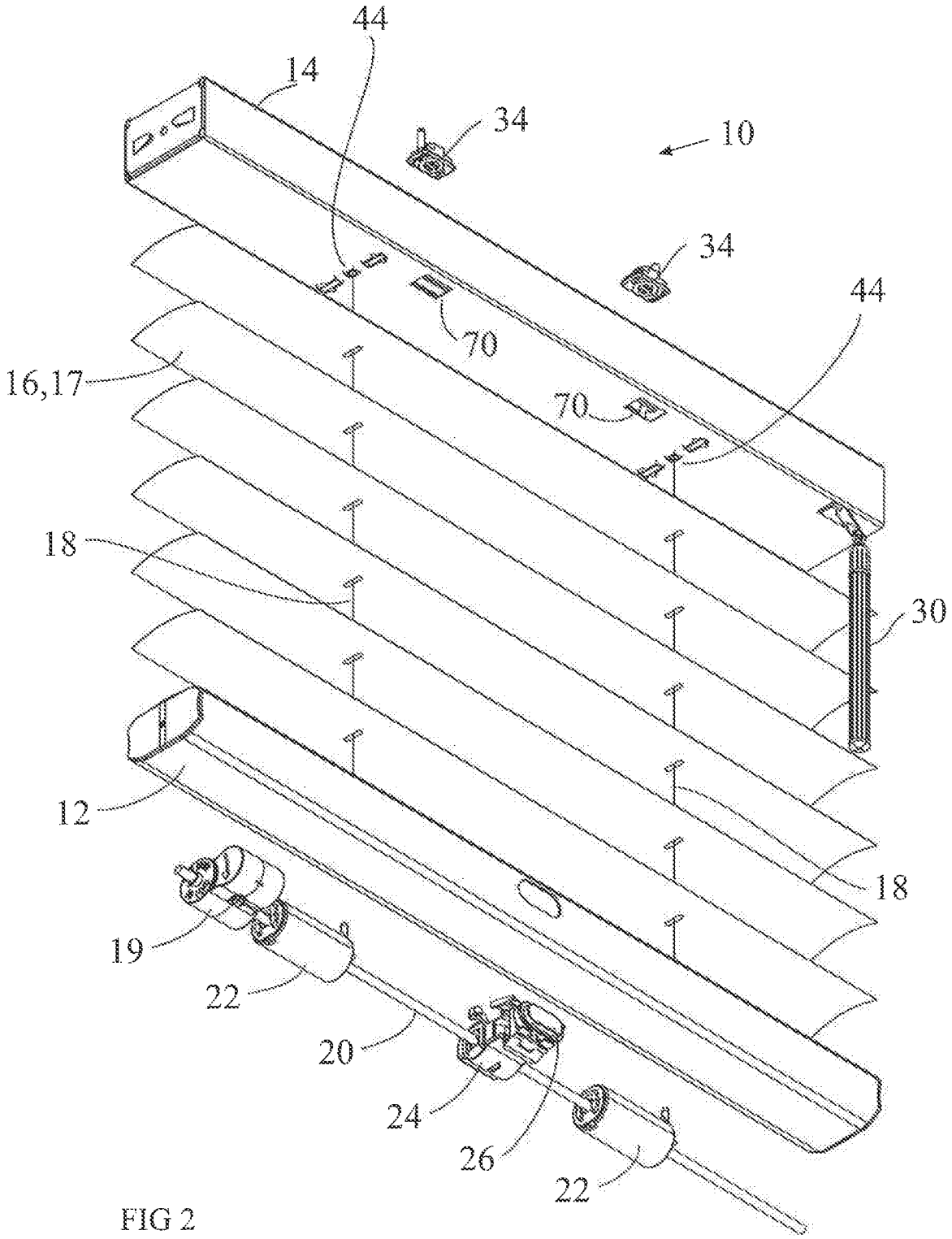
FIG. 2 illustrates a partially exploded, perspective view of the window covering of FIG. 1.

Referring to the drawings, FIGS. 1 and 2 show a window covering 10 with a movable rail 12, a stationary rail 14, and a covering material 16 extending between the movable rail 12 and the stationary rail 14. The movable rail 12 is coupled with the stationary rail 14 via lift cords 18. A drive motor 19, housed in the bottom rail 12, rotates a lift rod 20 which rotates lift spools on lift stations 22 to effect movement, such as raising and lowering, of the movable rail 12 and the covering material.

In the embodiment of FIGS. 1 and 2, the covering material is in the form of slats 17. However, principles of the disclosure may be applied to window coverings having other covering materials as known to those of ordinary skill in the art. Moreover, it will be appreciated that in the embodiment of FIGS. 1 and 2, movable rail 12 is a bottom rail which moves up and down with respect to the stationary rail 14, which, in the embodiment of FIGS. 1 and 2, is a top rail. However, principles of the disclosure are applicable to other orientations of window coverings. Moreover, stationary rail 14 need not even be stationary, and principles of the disclosure are applicable to two movable rails which are coupled together via a lift cord. Accordingly, reference to "movable," "bottom," "stationary," or "top" rails herein are for the sake of convenience and without intent to limit.

In the embodiment of FIGS. 1 and 2, in order to move the movable rail 12, a user presses on a button 26 to release a brake 24 and then moves the movable rail 12 to the desired position. When the movable rail 12 is in the desired position, the user releases the button 26, and the brake 24 engages and prevents the lift rod 20 from rotating, which prevents rotation of the lift spools in the lift stations 22 to prevent any further movement of the movable rail 12 relative to the stationary rail 14.

As best illustrated in FIGS. 3 through 6, a window covering 10 with slats 17, as in FIGS. 1 and 2, typically includes a tilt station 28 (typically mounted in the head rail, such as top stationary rail 14 in FIGS. 1 and 2) operatively connected to a tilt wand 30 (See FIGS. 1 and 2) via a tilt rod 32. The tilt station 28 drives a ladder tape (not shown) to rotate the slats 17 from an open position (as shown in FIG. 1) to a closed position, as is well known in the industry.

Figure 6:
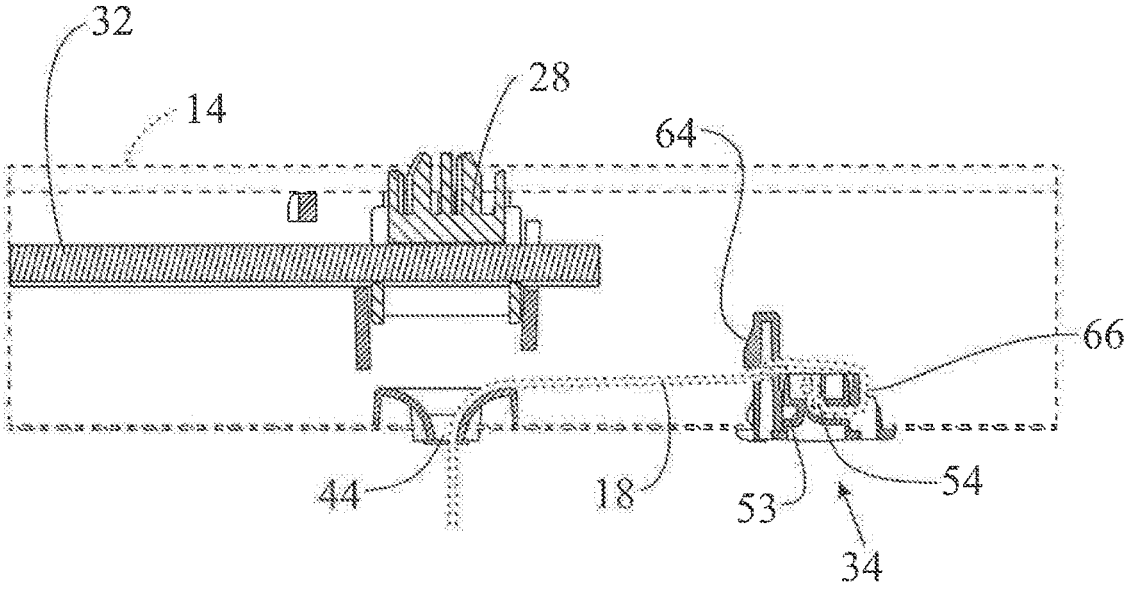
FIG. 6 illustrates a section view of the headrail of FIG. 5 taken about line 6-6.

An opening 44 (See FIG. 6) is provided through the stationary rail 14 (such as below the tilt station 28, if provided) through which the lift cord 18 passes. As shown in FIG. 6, the opening 44 provides a radiused guide surface for the lift cord 18 as the lift cord 18 enters the stationary rail 14, to guide the lift cord 18 to a skew adjustment mechanism 34. Each lift cord 18 has first and second ends, with the first end being secured to a lift spool at a respective lift station 22 on the movable rail 12, and the second end being secured to an anchor drum 38 (See FIG. 3) of the skew adjustment mechanism 34, as described in more detail below.

Figure 7:
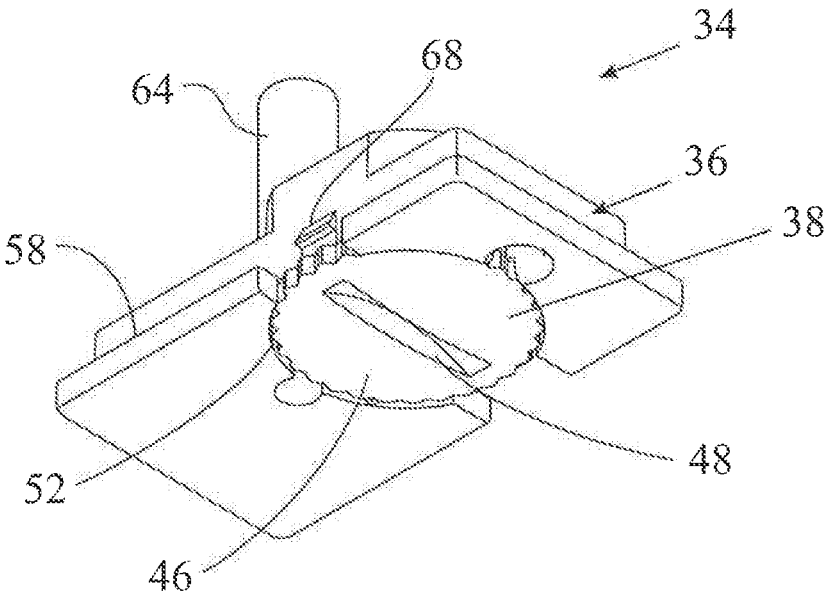
FIG. 7 illustrates an enlarged, perspective view of the one of the skew adjustment mechanisms of FIG. 2.
Figure 8:
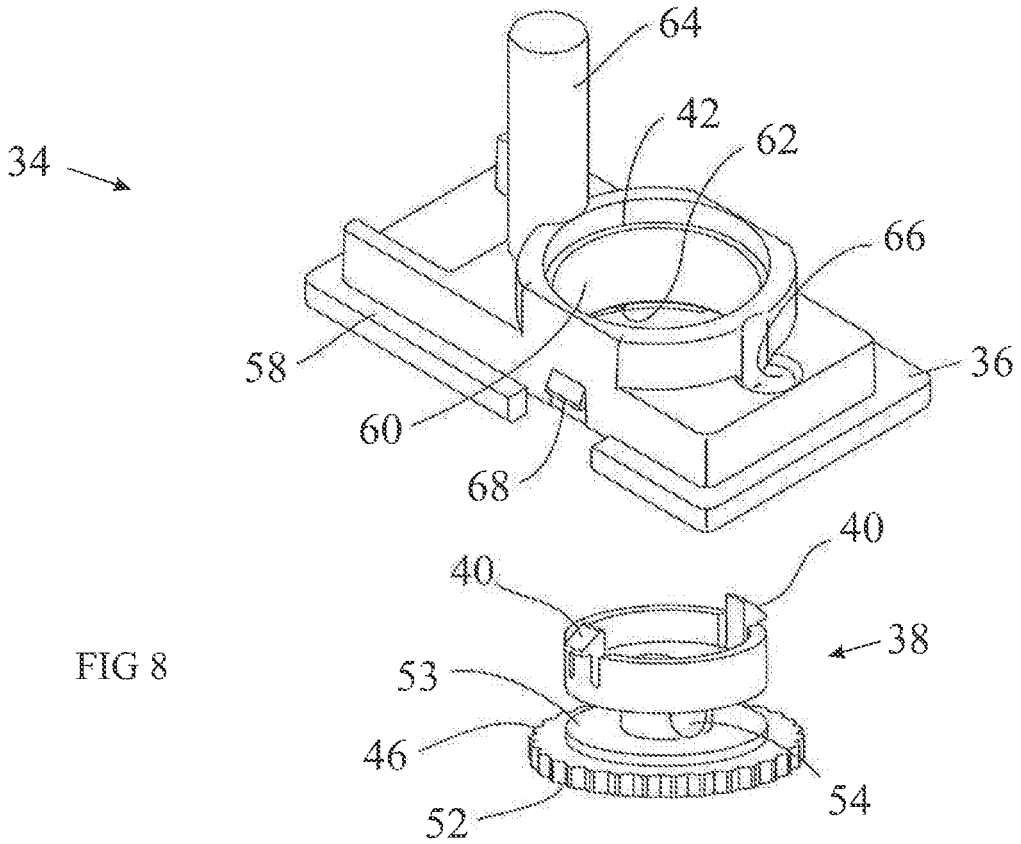
FIG. 8 illustrates an exploded, perspective view of the skew adjustment mechanism of FIG. 3.

FIGS. 7 and 8 show, in more detail, an example of a skew adjustment mechanism 34 which may be modified in accordance with principles of the present disclosure. The skew adjustment mechanism 34 includes an anchor housing 36 and an anchor drum 38 mounted in the anchor housing 36 for selective rotation relative to the anchor housing 36. In the embodiment of FIG. 8, the anchor drum 38 is a hollow, substantially cylindrical element which enters upwardly and snaps into the anchor housing 36. As illustrated in FIG. 8, flexible tabs 40 on the upper end of the anchor drum 38 spring outwardly to engage a circumferential lip 42 on the anchor housing 36 to suspend the anchor drum 38 from the anchor housing 36.

The bottom end of the example anchor drum 38 illustrated in FIG. 7 is closed off by a cover 46, which is fixed relative to the anchor drum 38. The cover 46 defines an elongated slot 48 in its bottom surface as well as a plurality of radially directed teeth 52 along the circumference of the cover 46. The slot 48 may be used to rotate the anchor drum 38, such as by insertion of a tool within the slot 48 and rotation of the tool to cause the anchor drum 38 to rotate. The radially directed teeth 52 may engage a stop, such as a rib 62 (See FIG. 9) on the housing 36, to provide a holding force, which prevents the anchor drum 38 from rotating once the user has rotated the anchor drum 38 into the desired position.

Figure 3:
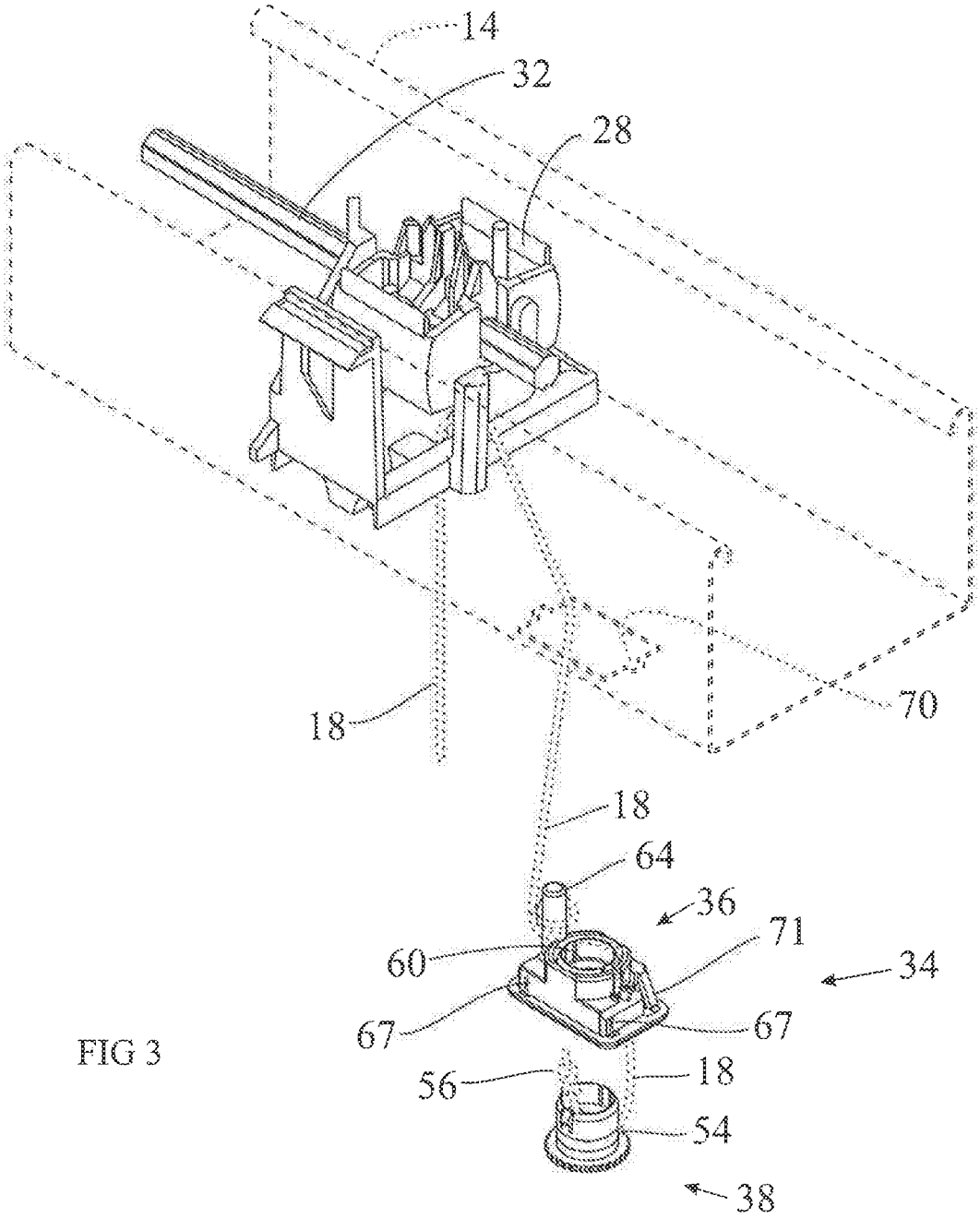
FIG. 3 illustrates a partially exploded, broken away, perspective view of the head rail of FIG. 1, with the head rail itself being shown in phantom lines.

In the embodiment of FIGS. 6 and 8, a recessed cylindrical wall 53 is formed on the anchor drum 38 and provides a surface onto which the lift cord 18 wraps without interfering with the rotation of the anchor drum 38 inside the anchor housing 36. An opening 54 through the recessed cylindrical wall 53 (see FIGS. 3 and 8) provides cord access to the interior of the cylindrical wall 53, where the second end of the lift cord 18 is secured onto the anchor drum 38, such as by being tied off with a knot 56 that is larger than the opening 54. As shown in the embodiment of FIG. 3, the end of the lift cord 18 is fed through the opening 54 to the inside of the anchor drum 38, and a knot 56 is tied at the end of the lift cord 18. The knot 56 is too large to pass through the opening 54, so, when the lift cord 18 is pulled outwardly, the knot 56 abuts the inner surface of the cylindrical wall 53 adjacent the opening 54, thereby securing the end of the lift cord 18 to the anchor drum 38.

Figure 9:
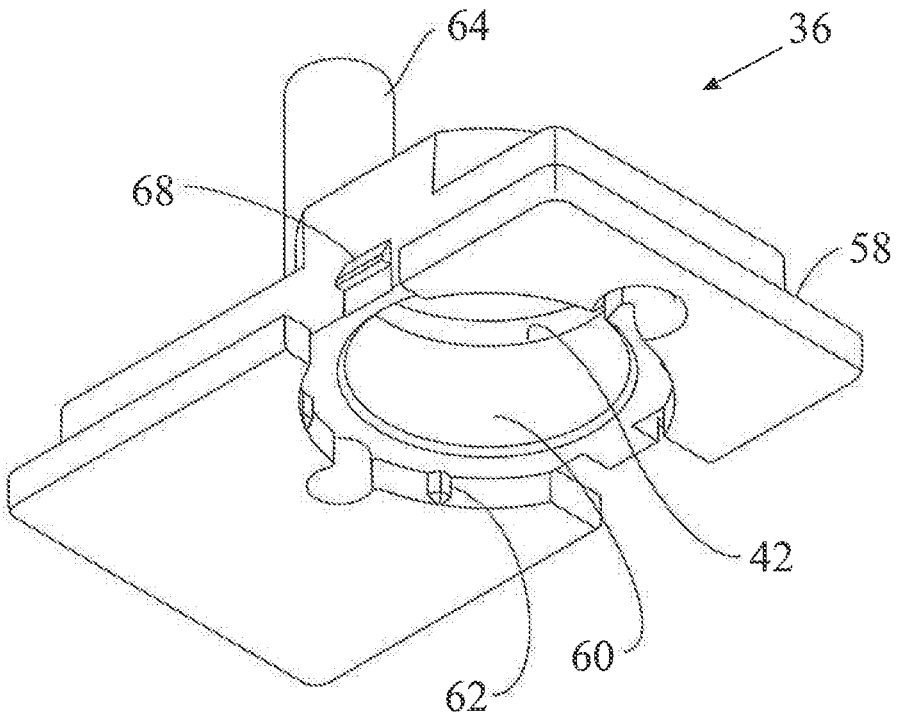
FIG. 9 illustrates a perspective view of the anchor housing of FIGS. 7 and 8.

Referring specifically now to the embodiment of FIGS. 8 and 9, the anchor housing 36 has a wall 60 which defines a substantially cylindrical cavity that receives the anchor drum 38. The wall 60 defines the aforementioned lip 42, which is engaged by the tabs 40 of the anchor drum 38 to secure the anchor drum 38 to the anchor housing 36 and to support the anchor drum 38 on the anchor housing 36. The aforementioned rib 62 projects inwardly from the lower part of the wall 60 to engage between two of the teeth 52 on the anchor drum 38 to provide a holding force against rotation of the anchor drum 38 relative to the anchor housing 36. It will be appreciated that other manners of holding the anchor drum 38 on the anchor housing 36 and against rotation are within the scope of the present disclosure.

Figure 4:
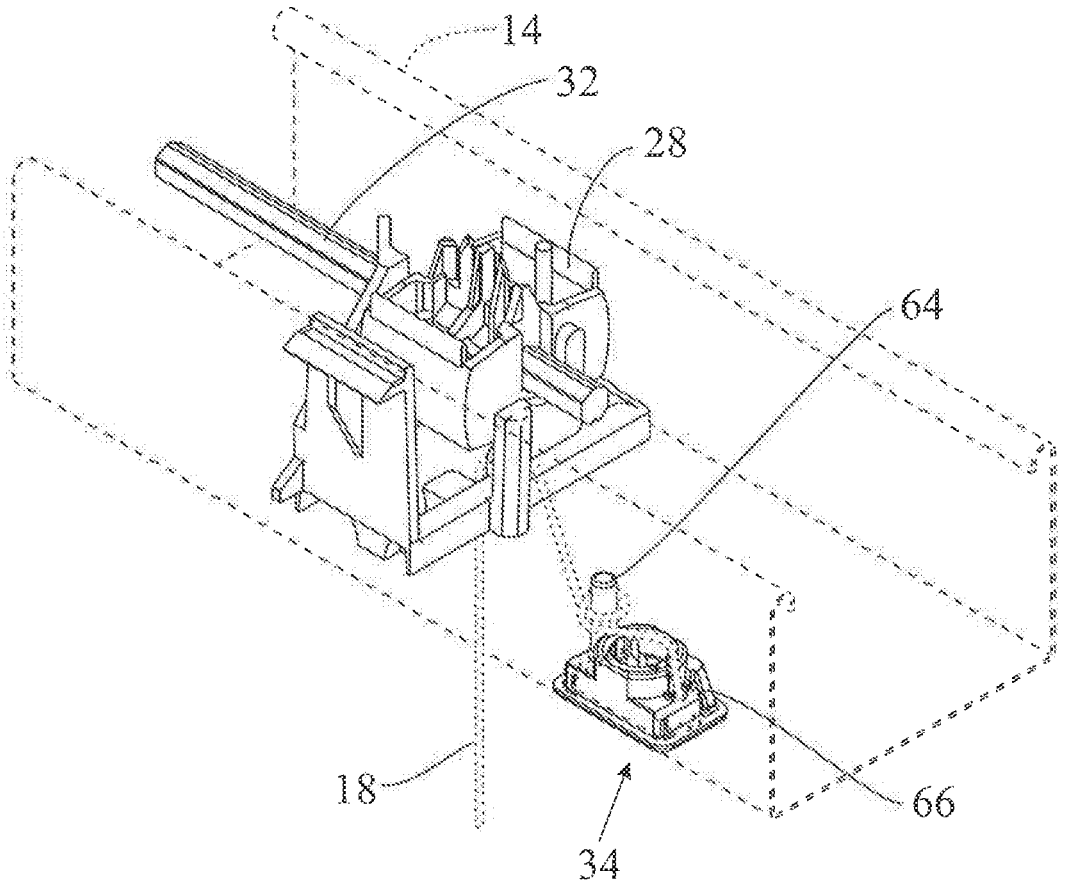
FIG. 4 illustrates the same view as FIG. 3 but with the skew adjustment mechanism assembled and mounted on the head rail in accordance with aspects of the present subject matter.
Figure 5:
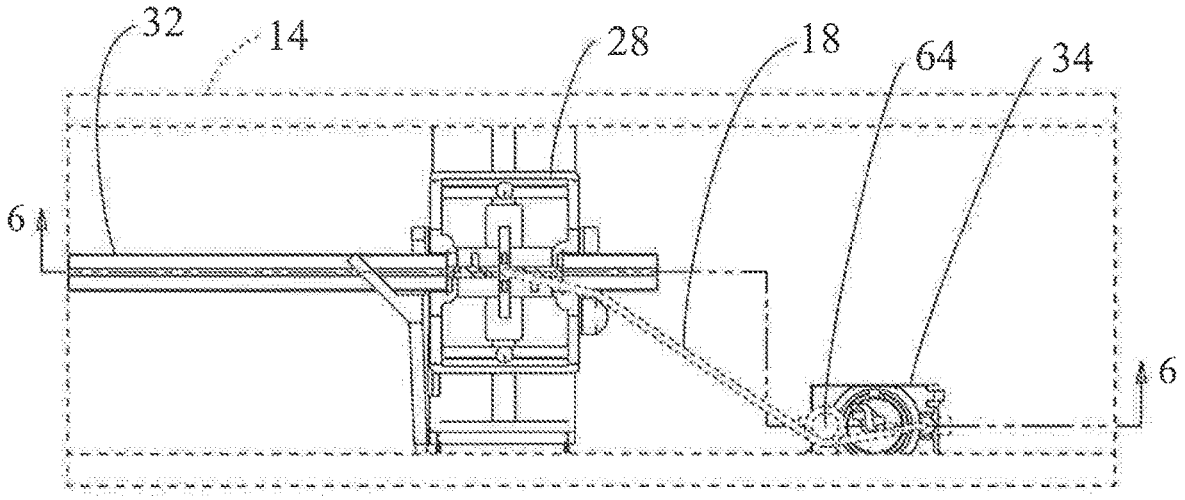
FIG. 5 illustrates a plan view of the head rail of FIG. 4.

A lift cord wrap post 64 projects upwardly from and is fixed relative to the anchor housing 36 between the first end of the lift cord 18 (e.g., secured to the lift spool) and the second end of the lift cord 18 (e.g., secured to the anchor drum 38), such as just outside of the cylindrical wall 60. In the embodiment illustrated in FIG. 8, on the opposite side of the anchor housing 36 is a cord outlet opening 66 which provides a pathway for the lift cord 18 to enter the cavity formed by the cylindrical wall 60 of the anchor housing 36 and be secured to the anchor drum 38 (as shown in FIGS. 3 and 4). It should be appreciated that it is not necessary to locate the cord outlet opening 66 diametrically opposite to the post 64. Instead, the cord outlet opening may be located at any convenient place adjacent to the cylindrical wall 60. Additionally, the housing 36 in the embodiment of FIGS. 7 and 8 further defines a pair of flexible tabs 68 for releasably securing the anchor housing 36 to the rail 14 at the through opening 70 of the rail 14 (See FIG. 3), as shown in FIG. 4. A flange 58 around the bottom perimeter of the anchor housing 36 abuts the bottom, outer surface of the top rail 14 when the anchor housing 36 is pushed upwardly through the skew-adjustment-mechanism-opening 70 in the rail 14 and is snapped into the rail.

Assembly and Operation of the Skew Adjustment Mechanism

One manner in which the skew adjustment mechanism 34 illustrated in the Figures may be assembled on a window covering is as follows. The first end of the lift cord 18 is secured to the lift spool in the lift station 22. The free end (the second end) of the lift cord 18 is fed up through the openings in the slats 17 of the covering 10 and then is fed up through the opening 44 (See FIG. 6) in the rail 14. Before the skew adjustment mechanism 34 is assembled or mounted on the rail 14 (See FIG. 3), the lift cord 18 is fed down through the opening 70 in the rail 14, is then wrapped once (or more) around the cord wrap post 64, is then fed through the opening 66 in the anchor housing 36 and then through the opening 54 in the anchor drum 38 to the interior of the anchor drum 38. The free end of the lift cord 18 is then fished out of the hollow cylindrical body of the anchor drum 38. As described earlier, a knot 56 (or other enlargement) is formed at the free end (the second end) of the lift cord 18 to anchor the lift cord 18 to the anchor drum 38. The anchor drum 38 may be rotated, if desired, to put one or more wraps of lift cord 18 onto the outer surface of the wall 53 of the anchor drum 38 before inserting the anchor drum 38 into the anchor housing 36.

The anchor drum 38 is then inserted into the cavity formed by the wall 60 of the anchor housing 36 until the tabs 40 on the anchor drum 38 snap over the circular lip 42 on the anchor housing 36. The assembled skew adjustment mechanism 34 is then inserted into the opening 70 in the rail 14 until the tabs 68 on the anchor housing 36 snap onto the rail 14, securing the assembled skew adjustment mechanism 34 in a fixed position on the rail 14. At this point, the tabs 40 and the lip 42 provide bearing surfaces for supporting the anchor drum 38 for rotation when the anchor drum 38 is manually rotated relative to the anchor housing 36 to adjust the length of the lift cord 18.

This process may be repeated for each skew adjustment mechanism 34 associated with each lift cord 18, as shown in FIG. 1. It should be noted that there may be only a single skew adjustment mechanism 34 present in a window covering 10, especially if there are only two lift cords 18 present in the covering 10. However, there also may be a skew adjustment mechanism 34 for each (some, most, or all) of the lift cords 18 in a window covering. If there is a skew adjustment mechanism 34 for each lift cord 18, then the skew adjustment mechanisms 34 also may be used to adjust the overall length of the covering.

The user may then insert a tool into the slot 48 of the anchor drum 38 to rotate the anchor drum 38 in order to adjust the length of the respective lift cord 18 (See FIG. 1) as desired to ensure that each lift cord 18 is the proper length so that the movable rail 12 is not skewed and so that the weight of the covering 16 is evenly distributed onto all the lift cords 18. To shorten a lift cord 18, the user manually moves the movable rail 12 closer to the cord wrap post 64 to relieve the tension on the lift cord 18, which allows the lift cord 18 to slip more readily around the cord wrap post 64. The user then can rotate the anchor drum 38 relative to the anchor housing 36 so as to wind up or unwind the lift cord 18 on the anchor drum 38. This may be done by inserting the blade of a flat screwdriver (or some other tool such as the edge of a coin, for instance) into the slot 48 on the anchor drum 38 and rotating the anchor drum 38 in the desired direction.

In order to rotate the anchor drum 38 relative to the anchor housing 36 to adjust the length of the lift cord 18 coupled thereto, a user will have to overcome the resistance posed by the mechanism provided to hold the anchor drum 38 in place, such as, in the embodiment of FIGS. 7-9, by overcoming the resistance posed by the rib 62 of the anchor housing 36 against the teeth 52 on the anchor drum 38. The lift cord can more readily slip around the cord wrap post 64 when the tension on the lift cord 18 is relieved (such as by lifting the movable rail 12) while the user is rotating the anchor drum 38 to lengthen or shorten the lift cord 18.

However, as soon as the user allows the movable rail 12 to move away from the cord wrap post 64, tension on the lift cord 18 is reestablished, which creates sufficient friction between the cord wrap post 64 and the portion of the lift cord 18 wrapped around the post 64, to reduce the load exerted by the lift cord 18 on the anchor drum 38, so that a relatively light holding force on the anchor drum (such as between the rib 62 and the teeth 52 of the illustrated embodiments) prevents the anchor drum 38 from rotating, even when the covering 10 is large and/or heavy, and even if the window covering 10 is lowered swiftly and/or stopped abruptly. In other words, when the user allows the movable rail 12 to move away from the cord wrap post 64, the tension is re-established on the lift cord 18, creating sufficient supplemental holding force between the cord wrap post 64 and the portion of the lift cord 18 wrapped around the post 64 to reduce the required holding force on the anchor drum 38 (e.g., between the rib 62 and the teeth 52) to prevent the anchor drum 38 from rotating due to the force from the lift cord 18.

Figure 10:
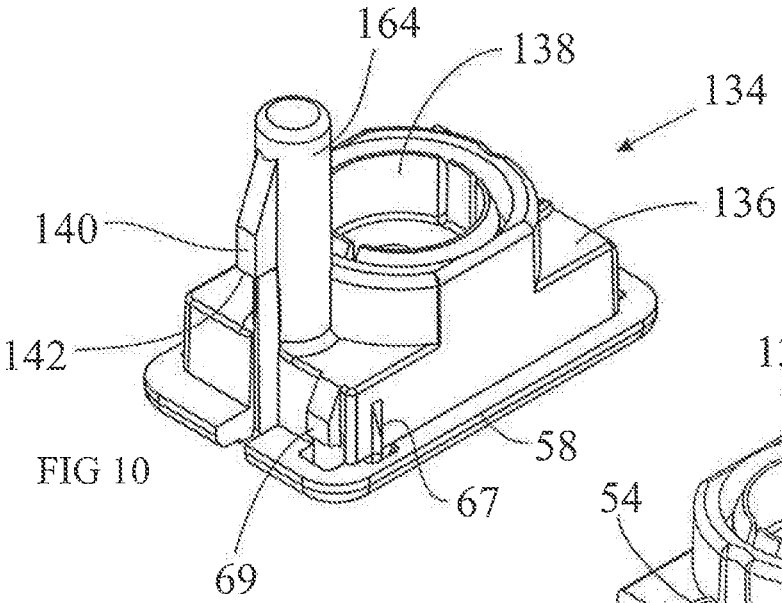
FIG. 10 illustrates a left side perspective view of another embodiment of an anchor housing and anchor drum for a skew adjustment mechanism in accordance with aspect of the present subject matter.
Figure 12:
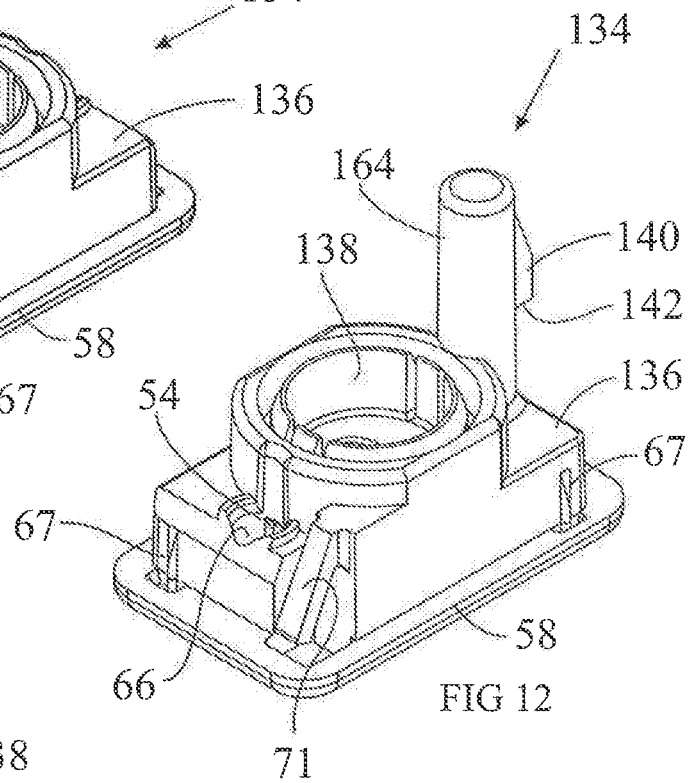
FIG. 12 illustrates a right side, perspective view of the anchor housing and anchor drum of FIG. 10.
Figure 11:
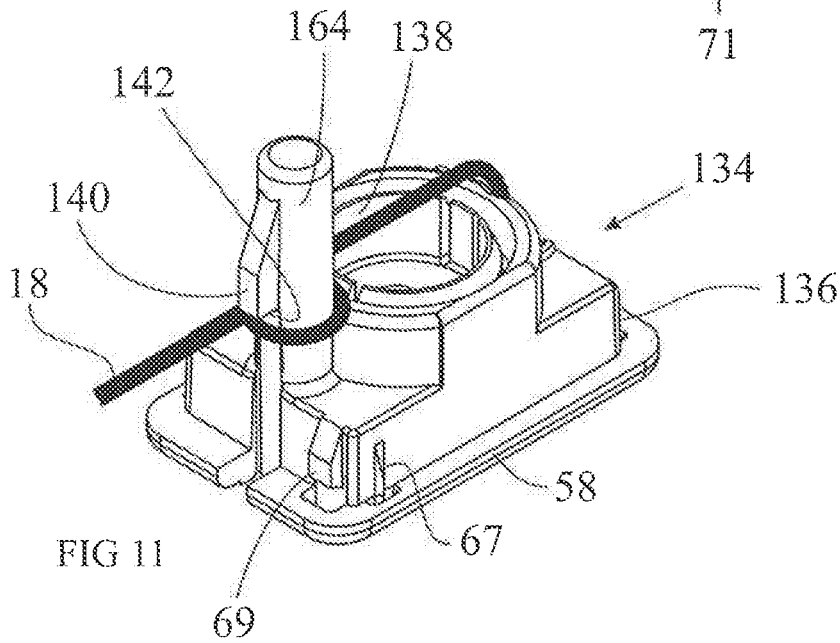
FIG. 11 illustrates the same view as FIG. 10 but adding a lift cord.

FIGS. 10-12 show a second embodiment of a skew adjustment mechanism 134 which is very similar to the skew adjustment mechanism 34 of FIGS. 7 and 8. This skew adjustment mechanism 134 includes an anchor drum 138 which is substantially identical to the anchor drum 38 described earlier, and an anchor housing 136 which differs from the anchor housing 36 described earlier in that the post 164 includes a radially-directed projection 140 which defines a retaining shoulder 142. The purpose of this retaining shoulder 142 is to prevent the lift cord 18 from migrating upwardly along the post 164 and slipping over the top of the post 164.

As may be appreciated, the anchor housing 136 may be manufactured in commercial quantities by casting using a mold. When molded, a post (e.g., the post 64 shown in FIG. 4) typically has a slight taper to enable the part to release from the mold, with the diameter of the top of the post (e.g., the free end of post 64) being slightly smaller than the diameter of the bottom of the post (e.g., the anchor end of the post 64). This slight taper may allow the portion of the lift cord 18 that is wrapped around the post to migrate upwardly along the longitudinal axis of the post. In a worst case scenario, the lift cord 18 may migrate all the way to the top of the post, wherein the loop formed by the lift cord 18 around the post may slide off of the top of the post. As shown in the illustrated embodiment, the retaining shoulder 142 on the post 164 of FIGS. 10 and 11 provides an abrupt edge against which the loop of the lift cord 18 will abut as the loop of the lift cord slides upwardly along the post 164 and serves as a stop against upward migration of the lift cord 18 along the post 164. Thus, the portion of the lift cord 18 that is wrapped around the post 164 between the retaining shoulder 142 and the anchor end of the post 164 will not migrate upwardly beyond the retaining shoulder 142 to slip over the free top end of the post 164.

The anchor housing 136 of FIG. 10-12 also has some elements which help retain the anchor housing 136 on the rail 14. For instance, crush ribs 67 may be provided which are crushed against the edge of the opening 70 of the rail 14 as the anchor housing 136 is inserted into the opening 70. A rigid retaining projection 69, which has a ramped top surface at a steep angle and a bottom surface at a less steep angle, may be provided instead or in addition to the crush ribs 67. Additionally, or alternatively, a flexible leg 71 may be provided opposite the rigid retaining projection 69 on the anchor housing 136. The anchor housing 136 may be inserted into the opening 70 of the rail 14 so that the rigid retaining projection 69 is inserted first, and then the remainder of the anchor housing 136 may be pivoted into the opening 70, causing the flexible leg 71 to deflect inwardly as the anchor housing 136 is inserted into the opening 70. The flexible leg 71 may then spring back to its original position, so that its bottom edge rests on the top surface of the rail 14 adjacent to the opening 70, with the flange 58 abutting the opposite surface of the rail 14 adjacent to the opening 70, as described earlier, thereby holding the anchor housing 136 in place within the opening 70. These retaining elements (e.g., the crush ribs 67, the rigid retaining projection 69, and the flexible leg 71) may also be used on the first embodiment shown in FIGS. 1-9.

It should be appreciated that, while the embodiments have been generally described and illustrated herein with reference to a Venetian blind, the present subject matter may be used for other types of window coverings, such as a pleated shade. Additionally, it should be appreciated that, while the holding force for the anchor drum in the illustrated embodiments is provided by a rib 62 and corresponding teeth 52, various other holding mechanisms are known and may be used instead. For example, a spring brake may be used to provide the holding force while still allowing the user to rotate the anchor drum 38 for adjusting the length of the lift cord 18.

In the foregoing description, it will be appreciated that the phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, counterclockwise, and/or the like) are only used for identification purposes to aid the reader's understanding of the present disclosure, and/or serve to distinguish regions of the associated elements from one another, and do not limit the associated element, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

While the foregoing description and drawings represent exemplary embodiments of the present subject matter, it will be understood that various additions, modifications, and substitutions may be made therein without departing from the spirit and scope of the present subject matter or the principles thereof. For instance, it will be clear to those skilled in the art that the present subject matter may be embodied in other specific forms, structures, arrangements, proportions, and with other elements, materials, components, and otherwise, such as may be particularly adapted to specific environments and operative requirements, without departing from the spirit or essential characteristics thereof. While the disclosure is presented in terms of embodiments, it should be appreciated that the various separate features of the present subject matter need not all be present in order to achieve at least some of the desired characteristics and/or benefits of the present subject matter or such individual features. It will be appreciated that various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations, and features described with respect to one embodiment typically may be applied to another embodiment, whether or not explicitly indicated. Accordingly, individual features of any embodiment may be used and can be claimed separately or in combination with features of that embodiment or any other embodiment. Moreover, elements shown as integrally formed may be constructed of multiple parts or elements shown as multiple parts may be integrally formed, the operation of elements may be reversed or otherwise varied, the size or dimensions of the elements may be varied. Therefore, the present disclosure is not limited to only the embodiments specifically described herein. The presently disclosed embodiments are therefore to be considered in all respects as illustrative and not restrictive, the scope of the subject matter being indicated by the appended claims, and not limited to the foregoing description.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

It will be obvious to those skilled in the art that various other modifications may be made to the embodiments described above without departing from the scope of the present subject matter as claimed.

What is claimed is:

1. A method for adjusting the skew of a covering including a rail, a cord wrap post, a lift cord extending from the rail and being wrapped around the cord wrap post, and a skew adjustment mechanism coupled to the lift cord, said method comprising:

relieving a cord tension on the lift cord to reduce an amount of friction provided between the lift cord and the cord wrap post by moving the rail to a position closer to the cord wrap post;

manipulating the skew adjustment mechanism while the cord tension on the lift cord is relieved to adjust an orientation of the rail; and reestablishing the cord tension on the lift cord to increase the amount of friction provided between the lift cord and the cord wrap post.

2. The method of claim 1, wherein reestablishing the cord tension on the lift cord comprises moving the rail away from the cord wrap post.

3. The method of claim 1, further comprising wrapping the lift cord around the cord wrap post at least once to create at least one cord loop relative to the cord wrap post;

wherein the cord tension on the lift cord impacts the amount of friction provided between the at least one cord loop and the cord wrap post.

4. The method of claim 1, wherein:

the covering further comprises a second cord wrap post, a second lift cord extending from the rail and being wrapped around the second cord wrap post, and a second skew adjustment mechanism coupled to the second lift cord; and the method further comprises:

relieving a cord tension on the second lift cord to reduce an amount of friction provided between the lift cord and the second cord wrap post;

manipulating the second skew adjustment mechanism while the cord tension on the second lift cord is relieved to adjust an orientation of the rail; and reestablishing the cord tension on the second lift cord to increase the amount of friction provided between the second lift cord and the second cord wrap post.

5. The method of claim 1, wherein:

the lift cord includes a first portion coupled to an anchor drum of the skew adjustment mechanism and a second portion coupled to a lift spool provided in operative association with the rail; and the cord wrap post is positioned at a location between the anchor drum and the lift spool along a cord path of the lift cord extending between the first and second portions of the lift cord.

6. The method of claim 1, wherein manipulating the skew adjustment mechanism while the cord tension on the lift cord is relieved to adjust the orientation of the rail comprises manipulating the skew adjustment mechanism while the cord tension on the lift cord is relieved to adjust a length of the lift cord.

7. The method of claim 1, wherein:

the rail comprises a movable rail of the covering;

the cord wrap post is provided in operative association with a fixed rail of the covering; and moving the rail to the position closer to the cord wrap post comprises moving the movable rail towards the fixed rail to reduce a distance defined between the movable and fixed rails.

8. The method of claim 7, wherein:

the skew adjustment mechanism is provided in operative association with the fixed rail;

a lift spool of the covering is provided in operative association with the movable rail; and a portion of the lift cord is wrapped around the lift spool.

9. The method of claim 1, wherein manipulating the skew adjustment mechanism comprises adjusting a movable component of the skew adjustment mechanism relative to the cord wrap post to adjust the orientation of the rail.

10. The method of claim 9, wherein the cord wrap post is spaced apart from the movable component.

11. The method of claim 9, wherein:

the movable component is supported for rotation by a housing of the skew adjustment mechanism; and the cord wrap post is fixed relative to housing.

12. A method for assembling a covering including a fixed rail, a movable rail that is movable relative to the fixed rail, a lift spool provided in operative association with the movable rail, a lift cord, a cord wrap post, and a skew adjustment mechanism provided in operative association with the fixed rail, said method comprising:

coupling a first portion of the lift cord to the lift spool;

wrapping the lift cord at least once around the cord wrap post;

coupling a second portion of the lift cord to the skew adjustment mechanism, the lift cord being wrapped around the cord wrap post at a location along a cord path of the lift cord defined between the lift spool and the skew adjustment mechanism; and selectively adjusting the skew adjustment mechanism to adjust a length of the lift cord defined between the movable rail and the fixed rail.

13. The method of claim 12, further comprising:

extending the lift cord from the movable rail to the fixed rail; and feeding the lift cord through an opening defined in the fixed rail prior to wrapping the lift cord around the cord wrap post.

14. The method of claim 12, further comprising relieving a cord tension on the lift cord to reduce an amount of friction provided between the lift cord and the cord wrap post as the skew adjustment mechanism is being selectively adjusted.

15. The method of claim 14, further comprising reestablishing the cord tension on the lift cord to skew adjustment mechanism has been selectively adjusted.

16. The method of claim 14, wherein relieving the cord tension on the lift cord comprises lifting the movable rail to reduce the amount of friction provided between the lift, cord and the cord wrap post.

17. The method of claim 16, wherein lifting the movable rail comprises moving the movable rail to a position closer to the cord wrap post.

18. A method for adjusting the skew of a covering including a rail, a cord wrap post, a lift cord extending from the rail and being wrapped around the cord wrap post, and a skew adjustment mechanism coupled to the lift cord, said method comprising:

relieving a cord tension on the lift cord to reduce an amount of friction provided between the lift cord and the cord wrap post;

rotating a movable component of the skew adjustment mechanism while the cord tension on the lift cord is relieved such that a portion of the cord is unwound from or wound around the movable component with rotation of the skew adjustment mechanism in a manner that adjusts a length of the cord from an initial length to an adjusted length, the adjusted length of the lift cord being associated with a desired orientation of the rail; and reestablishing the cord tension on the lift cord to increase the amount of friction provided between the lift cord and the cord wrap post.

19. The method of claim 18, wherein the rail is maintained at the desired orientation after the cord tension on the lift cord is reestablished.

20. The method of claim 18, wherein relieving the cord tension on the lift cord comprises moving the rail to a position closer to the cord wrap post.

21. The method of claim 18, wherein:

the rail comprises a movable rail of the covering;

the lift spool is provided in operative association with the movable rail;

the skew adjustment mechanism is provided in operative association with a fixed rail of the covering; and the adjusted length is defined between the movable rail and the fixed rail.

* * * * *